US006397951B1

(12) United States Patent
Roberts

(10) Patent No.: US 6,397,951 B1
(45) Date of Patent: Jun. 4, 2002

(54) MARINE RISER AND METHOD OF USE

(75) Inventor: Stephen John Roberts, Bieldside (GB)

(73) Assignee: Coflexip Stena Offshore Limited (GB)

( * ) Notice: Subject to any disclaimer, the term of this patent is extended or adjusted under 35 U.S.C. 154(b) by 0 days.

(21) Appl. No.: 09/269,130

(22) PCT Filed: Jul. 16, 1998

(86) PCT No.: PCT/GB98/02113

§ 371 (c)(1),
(2), (4) Date: Mar. 19, 1999

(87) PCT Pub. No.: WO99/05388

PCT Pub. Date: Feb. 4, 1999

(30) Foreign Application Priority Data

Jul. 24, 1997 (GB) ..... 9715537

(51) Int. Cl.[7] ..... E21B 17/01; E21B 43/01
(52) U.S. Cl. ..... 166/380; 166/367; 175/7
(58) Field of Search ..... 166/352, 360, 166/367; 175/7, 380

(56) References Cited

U.S. PATENT DOCUMENTS

| | | | | | |
|---|---|---|---|---|---|
| 4,074,541 A | | 2/1978 | Lochridge | 61/110 |
| 4,188,156 A | * | 2/1980 | Fisher et al. | 405/195 |
| 4,273,471 A | * | 6/1981 | Burke | 405/203 |
| 4,728,224 A | * | 3/1988 | Salama et al. | 405/195 |
| 4,741,647 A | | 5/1988 | Dumazy et al. | 405/202 |
| 4,802,431 A | | 2/1989 | Pollack | 114/230 |
| 5,547,314 A | * | 8/1996 | Ames | 405/165 |
| 5,615,977 A | | 4/1997 | Moses et al. | 405/195.1 |
| 5,778,981 A | * | 7/1998 | Head | 166/345 |
| 6,042,303 A | * | 3/2000 | Head | 405/195.1 |
| 6,161,619 A | * | 12/2000 | Head | 166/355 |
| 6,276,456 B1 | * | 8/2001 | Head | 166/359 |

FOREIGN PATENT DOCUMENTS

| | | | |
|---|---|---|---|
| GB | 2099894 | 12/1982 | |
| GB | 2234772 A * | 2/1991 | E21B/17/01 |
| GB | 2320268 | 6/1998 | |
| WO | 9528316 | 10/1995 | |

OTHER PUBLICATIONS

Merriam–Webster's Collegiate Dictionary, 10th Edition, p. 445.*

* cited by examiner

*Primary Examiner*—David Bagnell
*Assistant Examiner*—Jennifer M Hawkins
(74) *Attorney, Agent, or Firm*—Ostrolenk, Faber, Gerb & Soffen, LLP

(57) ABSTRACT

A marine riser, particularly but not exclusively for use in connecting a subsea well installation to a dynamically positioned servicing vessel, comprises at least one section formed from rigid pipe and at least one section formed from flexible pipe. Preferably, the upper and lower sections (10, 12) are formed from fixed lengths of flexible pipe and the central section is formed from a plurality of lengths of rigid pipe which may be assembled to make up any required length. The riser may be deployed from a moonpool of the vessel and serves to accommodate movements of the vessel on the surface. This allows the use of a dynamically positioned service vessel rather than a conventional drilling rig.

13 Claims, 1 Drawing Sheet

MARINE RISER AND METHOD OF USE

BACKGROUND OF THE INVENTION

The present invention relates to a marine riser and to methods of using such a riser. The marine riser is useful for a variety of possible applications in the offshore oil and gas industry, but is particularly intended for use in the drilling, servicing ("well intervention") and abandonment of subsea well installations.

There is a need for a variety of maintenance and service operations to be carried out on subsea wellheads, following completion of the well and throughout the operational lifetime of the well. Many of such operations require a conduit ("riser") to connect the wellhead to the surface of the water, allowing coiled tubing or the like to be introduced into the bore of the well, through the riser. Conventionally, such operations have usually been performed using a riser formed from rigid steel drill pipe deployed from a conventional drilling rig (typically a mobile semi-submersible type rig). This has numerous disadvantages. Such rigs are expensive, slow in transit between tasks at different locations and cumbersome in use.

It would be desirable to carry out such operations using a conventional, dynamically-positioned drilling vessel, equipped with a standard oilfield derrick. Difficulties arise when using such a vessel with a conventional rigid riser, primarily because a vessel of this type is substantially less stable than a semi-submersible rig. In order to use such a vessel for the deployment of marine risers it is necessary to control bending moments arising from environmental loads on the riser and from roll, pitch, sway and yaw of the vessel.

This problem has been addressed in the past in a variety of ways, including:

(a) Rigid risers manufactured from high performance materials and/or with complex geometries which can absorb the bending forces. This approach is expensive in terms of materials and manufacturing costs.

(b) Application of extremely high tensions to the riser. This creates a whole range of other problems.

(c) Forming the riser wholly from flexible pipe. Such pipe is expensive, and the length of the riser must match the water depth quite closely, so that a range of different lengths will be required for different operations. A storage carousel for the flexible pipe is also required on the vessel, where deck space is limited.

(d) The use of "flex-joints", such as those marketed by Oil States Industries of Arlington, Tex., USA. A joint of this type comprises a short articulated conduit with a flexible coupling connecting two rigid conduit sections, one of which includes a massive collar enclosing an elastomeric bearing. Devices of this type are bulky, massive and extremely expensive, and accommodate only a limited range of riser deflections (typically +/−10°).

SUMMARY OF THE INVENTION

It is an object the invention to provide a marine riser which can be deployed from a conventional oilfield rig on a conventional dynamically-positioned drilling vessel and which obviates or mitigates the various problems outlined above. The riser may also be useful in other fields of application within the offshore engineering industry.

In accordance with a first aspect of the invention, there is provided a marine riser in which at least part of the length of the riser is formed from at least one length of rigid tubular pipe and at least part is formed from at least one length of flexible pipe.

In its preferred embodiment, the riser comprises a central rigid section and uppermost and lowermost flexible sections.

The at least one rigid section preferably comprises a plurality of rigid pipe joints assembled together to make up the length required and the at least one flexible section is pre-fabricated to a predetermined length.

The at least one flexible section may be provided with bend restricting devices adapted to resist bending and/or bend limiting devices adapted to limit the minimum radius to which the flexible pipe may be bent.

The various flexible and rigid sections may be connected to one another by any suitable means, including flange, hub and screw-threaded connectors, The ends of the riser are adapted for connection to subsea installations and to apparatus on board the vessel, respectively, as required for a particular operation. The lowermost end may have a package of apparatus connected thereto for connection to the subsea installation.

In accordance with a second aspect of the invention there is provided a method of deploying a marine riser between a vessel and a subsea installation, comprising lowering a riser from the vessel to the subsea installation and connecting the lower end of the riser to the subsea installation, wherein the riser includes at least one length of rigid tubular pipe and at least one length of flexible pipe.

Preferably, said at least one length of rigid tubular pipe comprises a plurality of pipe joints which are connected together as the riser is lowered from the vessel.

Preferably also, the method comprises lowering a first length of flexible pipe, connecting a first rigid pipe joint to an upper end of said flexible pipe, lowering said rigid pipe joint, connecting additional rigid pipe joints to the upper end of the preceding pipe joint and lowering said additional pipe joints, as required, connecting a second length of flexible pipe to the upper end of the last rigid pipe joint and lowering said second length of flexible pipe.

Preferably also, the vessel is a dynamically positioned vessel and the pipe is lowered from a derrick located on the vessel, via a moon-pool.

BRIEF DESCRIPTION OF THE DRAWING

Embodiments of the invention will now be described, by way of example only, with reference to the accompanying drawing which shows a side view of a marine riser in accordance with the invention being deployed from a dynamically positioned vessel.

DESCRIPTION OF A PREFERRED EMBODIMENT

Figure 1:
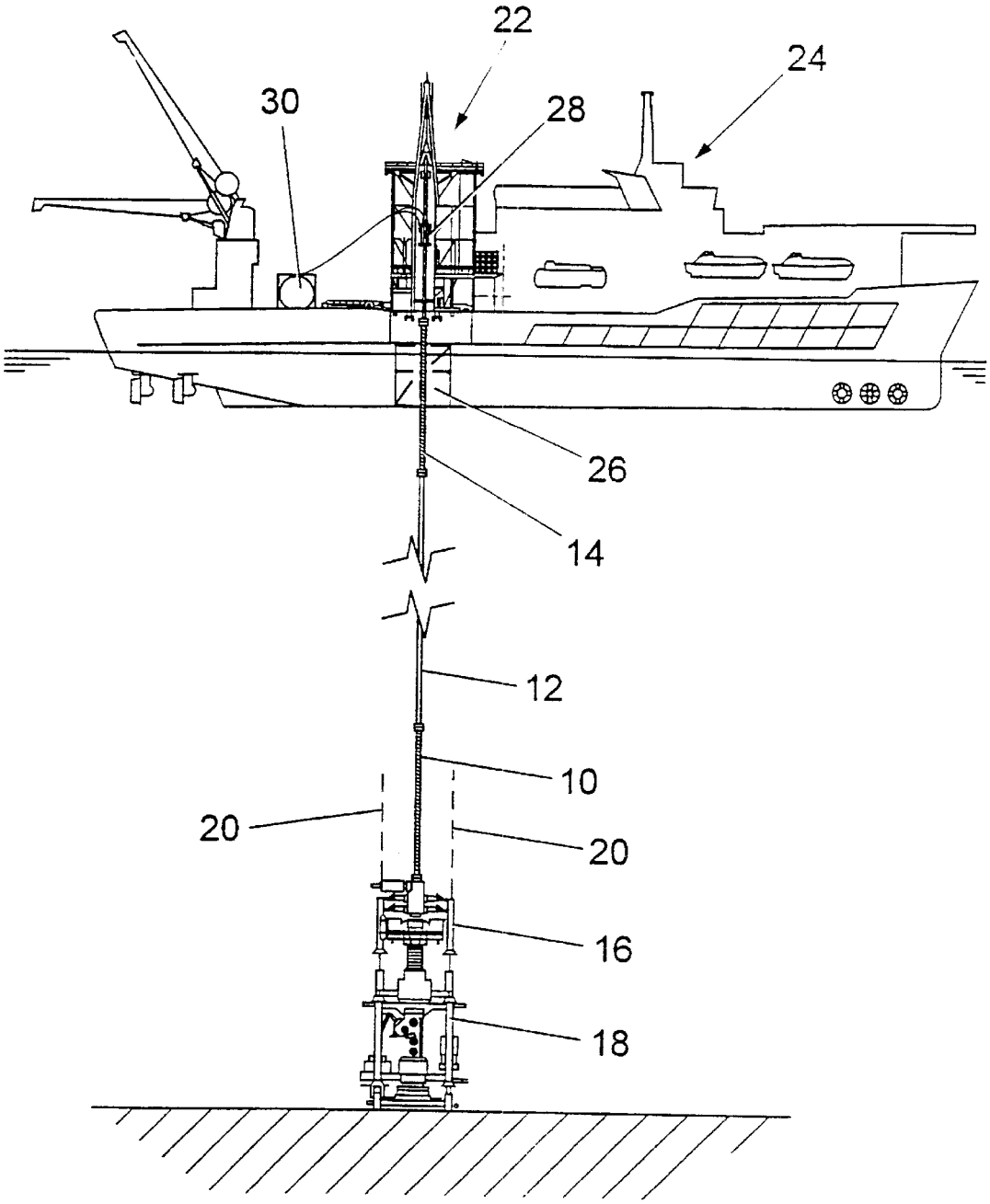

Referring now to the drawing, a marine riser embodying the first aspect of the invention comprises a lowermost length of flexible pipe 10, an intermediate length of rigid pipe 12 and an upper most length of flexible pipe 14. A lower riser package 16 is connected to the lowermost end of the lowermost flexible pipe 10 for connection to a subsea installation such as a subsea wellhead 18.

The rigid pipe may be of the same type used in conventional rigid risers. The flexible pipe is preferably of the type used for flexible marine risers, as described in detail in API 17B (Recommended Practice) and API 17J (Specifications).

Together, the sections 10, 12 and 14 of the riser make up a length sufficient to reach from the surface to the subsea wellhead 18, plus a degree of slack permitting movements of the vessel to be absorbed by the flexible sections 10 and 14. Optionally, guidelines 20 may also be used to assist deployment of the riser, as is well known in the art.

The riser is deployed using a conventional oilfield derrick 22, or equivalent, mounted on a dynamically positioned vessel 24, via a moon-pool 26. The derrick preferably incorporates motion compensation and/or constant tension apparatus, as is well known in the art.

The invention contemplates risers comprising at least one flexible and at least one rigid portion. The illustrated example is a preferred embodiment. However, it will be appreciated that the same objects could be achieved with different combinations of rigid and flexible sections. In general, it is preferred that at least the uppermost and lowermost sections be flexible.

The riser is deployed from the derrick in a manner similar to conventional drill pipe and risers. The first flexible section 10 would be lowered from the vessel with the package 16 connected to its lowermost end. Joints of drill pipe would then be connected and lowered to make up the required length of the rigid section 12 of the riser, and the final flexible section 14 would then be connected and lowered. The various lengths of flexible and rigid pipe may be connected by any suitable means, including flange, hub or screw-threaded connectors.

The flexible sections 10 and 14 of the riser may be fitted with bending restrictors (stiffeners), vertebrae (bending limiters) and integral or attached buoyancy, as is also well known in the art.

The rigid and flexible pipe employed will be selected according to the requirements of the task to be performed using the riser, so as to provide pressure containment, tensile support and fluid path, for example. The riser may also be configured to act as a conduit for coiled tubing, wireline and electric line activities, well stimulation, gas injection or water injection etc. The vessel will be equipped with appropriate apparatus for the task at hand, such as an injector head 28, coiled tubing reel 30 etc.

The riser is specifically intended for the deployment of lightweight risers for well-servicing and well-abandonment operations carried out from a dynamically positioned vessel using coiled tubing. However, it may also find application in a range of other marine oilfield activities, and could also be deployed from conventional semi-submersible drilling rigs and drilling ships.

The advantages of the invention over conventional alternatives include low cost, simplicity, ease of inspection and testing, compactness (allowing spare components to be carried by the vessel) and ability to be stacked up by conventional derrick equipment.

Improvements and modifications may be incorporated without departing from the scope of the invention.

What is claimed is:

1. A marine riser for the passage of objects from a floating vessel to a subsea installation, the marine riser comprising:

a lowermost section of flexible pipe toward the installation, a central section of rigid pipe, and an uppermost section of flexible pipe, said lowermost and uppermost sections of flexible pipe being made of a composite of layered material that forms a pressure containing conduit that allows large deflections without a significant increase in bending stresses; and said central section of rigid pipe comprising a plurality of rigid pipe sections assembled together in a row to a length between said uppermost and said lowermost sections of flexible pipe and said central section of rigid pipe being longer than said lowermost and said uppermost sections.

2. A marine riser as claimed in claim 1, in which said rigid pipe sections are drill pipe joints.

3. A marine riser as claimed in claim 1, in which at least one of said flexible sections is provided with bend restricting devices adapted to restrict bending.

4. A marine riser as claimed in claim 1, in which at least one of said flexible sections is provided with bend limiting devices adapted to limit the minimum radius to which said at least one flexible section may be bent.

5. A marine riser according to claim 1, further comprising means connecting each said section of flexible pipe and an adjacent said rigid pipe section respectively to one another, said means selected from the group consisting of flanges, hubs, and screw-threaded connectors.

6. A marine riser according to claim 1, wherein the rigid pipe is made of steel.

7. A method of deploying a marine riser between a vessel and a subsea installation, the marine riser being constructed from rigid pipe and flexible pipe, the flexible pipe comprising a composite of layered material that forms a pressure containing conduit that allows large deflections in the pie without significant increase in bending stress, the method comprising lowering the riser from the vessel to the subsea installation wherein the riser includes a lowermost section of flexible pipe, a rigid central section of the rigid pipe which includes a plurality of rigid pipe sections assembled together, and an uppermost section of flexible pipe, the central section of the rigid pipe being longer than the lowermost and uppermost sections of flexible pipe.

8. A method as claimed in claim 7, further comprising joining said rigid pipe sections together as said riser is lowered from the vessel.

9. A method as claimed in claim 8, comprising lowering a first length of flexible pipe, connecting a first rigid pipe section to an upper end of said first length of flexible pipe, lowering said first rigid pipe section, connecting additional rigid pipe sections each to an upper end of the preceding rigid pipe section and lowering said additional rigid pipe sections, connecting a second length of flexible pipe to an upper end of the last rigid pipe section lowered, and lowering said second length of flexible pipe.

10. A method as claimed in claim 9, in which said rigid pipe sections are drill pipe joints.

11. A method as claimed in claim 10, wherein the vessel is a dynamically positioned vessel, and the pipe is lowered from a derrick located on the vessel via a moonpool.

12. A marine riser for the passage of objects from a floating vessel to a subsea installation, the marine riser comprising:

a lowermost section of a first length of coiled tubing located toward the installation, a central section of steel pipe, and an uppermost section of a second length of coiled tubing located toward the vessel; and the central section of steel pipe comprising a plurality of steel pipe sections assembled together in a row to a length between said uppermost and said lowermost sections of coiled tubing.

13. A method of deploying a marine riser between a vessel and a subsea installation, the method comprising:

lowering a first length of coiled tubing from the vessel toward the installation;

connecting at least one steel pipe section to an upper end of the first length of coiled tubing and lowering the at least one steel section and the first length of coiled tubing toward the installation;

connecting a second length of coiled tubing to an upper end of the at least one steel pipe section; and lowering the second length of coiled tubing, the at least one steel pipe section and the first length of coiled tubing toward the installation.

* * * * *